US008657083B2

(12) United States Patent
Vigholm

(10) Patent No.: US 8,657,083 B2
(45) Date of Patent: Feb. 25, 2014

(54) METHOD FOR DAMPING RELATIVE MOVEMENTS OCCURRING IN A WORK VEHICLE DURING ADVANCE

(75) Inventor: Bo Vigholm, Stora Sundby (SE)

(73) Assignee: Volvo Construction Equipment AB, Eskilstuna (SE)

( * ) Notice: Subject to any disclaimer, the term of this patent is extended or adjusted under 35 U.S.C. 154(b) by 350 days.

(21) Appl. No.: 11/910,614

(22) PCT Filed: Apr. 4, 2005

(86) PCT No.: PCT/SE2005/000491

§ 371 (c)(1), (2), (4) Date: Apr. 28, 2008

(87) PCT Pub. No.: WO2006/107242

PCT Pub. Date: Oct. 12, 2006

(65) Prior Publication Data

US 2008/0210505 A1 Sep. 4, 2008

(51) Int. Cl.
*F16F 9/512* (2006.01)

(52) U.S. Cl.
USPC ..... 188/266.1

(58) Field of Classification Search
USPC ..... 188/266–322.5; 37/348, 466
See application file for complete search history.

(56) References Cited

U.S. PATENT DOCUMENTS 3,541,927 A 11/1970 Iijima
5,000,650 A * 3/1991 Brewer et al. ..... 414/699
6,352,143 B1 3/2002 Niaura et al.
6,850,828 B2 * 2/2005 Chen ..... 701/50
7,610,136 B2 * 10/2009 Okamura et al. ..... 701/50
2002/0073833 A1 * 6/2002 Coombs et al. ..... 91/35
2003/0230010 A1 * 12/2003 Sharkness et al. ..... 37/348
2006/0060750 A1 * 3/2006 Alexandridis ..... 248/588
2006/0156713 A1 7/2006 Kadlicko

FOREIGN PATENT DOCUMENTS

JP 05230999 * 9/1993
WO 2006060638 A2 6/2006

OTHER PUBLICATIONS

International Search Report for corresponding International Application PCT/SE2005/000491.

* cited by examiner

*Primary Examiner* — Robert A Siconolfi
*Assistant Examiner* — Vishal Sahni
(74) *Attorney, Agent, or Firm* — WRB-IP LLP

(57) ABSTRACT

A method for damping relative movements occurring between a first and a second part of a work vehicle during advance of the vehicle, which parts are interconnected by means of at least one hydraulic actuator, includes detecting at least one operation parameter of the vehicle, determining whether a damping condition is present based on the detected operation parameter and if the determined damping condition is present, controlling a displacement of a variable displacement hydraulic motor arranged downstream of the actuator in such a way that energy from a hydraulic fluid transmitted from the actuator is converted to a rotational energy in the motor, and transmitting the recovered energy from the motor to a power source.

13 Claims, 6 Drawing Sheets

METHOD FOR DAMPING RELATIVE MOVEMENTS OCCURRING IN A WORK VEHICLE DURING ADVANCE

BACKGROUND AND SUMMARY

The present invention relates to a method for damping relative movements occurring between a first and a second part of a work vehicle during advance of the vehicle, which parts are interconnected by means of at least one hydraulic actuator.

The term work vehicle comprises different types of material handling vehicles like construction machines, such as a wheel loader, a backhoe loader, a motor grader and an excavator. The invention will be described below in a case in which it is applied in a wheel loader. This is to be regarded only as an example of a preferred application.

Said actuator may be a linear actuator in the form of a hydraulic cylinder. A wheel loader comprises several such hydraulic cylinders in order to perform certain work functions. A first pair of hydraulic cylinders is arranged for turning (steering) the wheel loader. A second pair of hydraulic cylinders is arranged for lifting load-arm unit and a further hydraulic cylinder is arranged on the load arm unit for tilting an implement, for example a bucket or forks, arranged on the load arm unit.

It is known to damp relative movements between a load-arm unit and a forward vehicle section in a wheel loader by means of a load-arm unit suspension system.

By damping the movements, the comfort of the driver in the machine is increased and material that is being carried by the implement is prevented from leaving the implement. If, for example, a bucket is arranged on the load-arm unit, it is desirable that the material that is loaded in the bucket does not fall out of the bucket when the vehicle goes over a bump. A vehicle provided with large tyres uses the tyres as springs during advancing over an uneven surface. However, the tyres are not capable of effectively damping the jumping movements and pitching oscillations that occur in the vehicle body when the vehicle travels on an uneven surface.

When the vehicle goes over a bump in the surface, the vehicle body moves upwards. On account of the mass inertia in the load-arm unit, the load-arm unit tends to stay at its existing level above the surface. Instead of the load-arm unit following the vehicle body upwards, the pistons of the cylinders are forced into the cylinders, which means that hydraulic oil flows out of the cylinders.

According to a known suspension system, see for example WO 99/16981, an accumulator is arranged downstream of the cylinders. The gas present in the accumulator will thus be compressed when the vehicle goes over a bump. The pistons will be displaced into the cylinders as long as the pressure in the cylinders is lower than the pressure that is needed in order to overcome the accelerating force and the force of gravity from the load assembly. When the machine goes over a hole in the surface, the reverse sequence occurs, that is to say that hydraulic oil flows from the accumulator to the cylinders.

During work with the machine in, for example, a gravel pit, the load arm suspension system should be deactivated when the bucket is to be filled. The vehicle then drives with great force into a gravel heap, with the bucket located in front of it. It is then desirable that the load-arm unit is rotationally rigid and that the pistons in the cylinders maintain their set position. Subsequently, when the machine is to transport the gravel in the bucket, the load-arm unit suspension system is activated. On activation of the load arm suspension system, the load arm assembly is to maintain its set position.

The known suspension system in WO 99/16981 is passive. The lift cylinders are connected to at least one gas filled accumulator, which functions as a spring. The hydraulic fluid flowing with a certain pressure drop back and forth between the cylinder and the accumulator functions as a dampener. Further, friction in the load-arm unit and the cylinder contribute to the dampening function.

Further, when traveling over an uneven ground, large side acceleration forces are created around a steering joint in a frame steered vehicle, like a wheel loader. It is known to use accumulators in fluid connection to the steering cylinders, which accumulators have the effect of damping the relative movements between the frame parts also when the steering cylinders are not activated for steering the vehicle.

It is desirable to achieve a method for dampening the relative movements between a first and a second part of the work vehicle during advance of the vehicle, which recovers energy from said relative movements.

The method according to an aspect of the present invention comprises the steps of detecting at least one operation parameter of the vehicle, determining whether a damping condition is present based on the detected operation parameter and if the determined damping condition is present: controlling a displacement of a variable displacement hydraulic motor arranged downstream of the actuator in such a way that energy from a hydraulic fluid transmitted from the actuator is converted to a rotational energy in the motor, and transmitting the recovered energy from the motor to a power source.

Thus, the kinetic energy from undesired relative movements of the vehicle, like rocking or oscillating movements, will be recovered by this method. Further, by virtue of this energy recovery method, fuel consumption is reduced.

The method may be used for damping and energy recovery from several functions of the vehicle, like from the lifting function, tilting function and steering function. Relative motions may be damped and energy may be recovered simultaneously with a suitably designed system.

According to an aspect of the invention, the detected operation parameter is an angle between the first and second parts and/or a hydraulic fluid pressure associated to the actuator.

For example, the damping condition may be determined based on a predetermined change in said detected hydraulic fluid pressure. Further, one may determine if the desired pressure change is present for initiating an energy recovery phase by determining the frequency content of the detected pressure and/or a derivative of the detected pressure. In this way, it is determined if there is an operation condition present, such as a permanent rise in the pressure due to a heavier load or a temporary disturbance, which will not initiate an energy recovery phase.

According to an aspect of the invention, the method comprises the step of automatically moving the first and second parts relative to one another to a specific relative position, preferably by means of said actuator, after termination of an energy recovery phase. Said specific relative position is preferably the initial relative position of the two parts prior to initiation of the energy recovery operation.

BRIEF DESCRIPTION OF THE DRAWINGS

The invention will be explained below, with reference to the embodiments shown on the appended drawings, wherein FIG. 1 schematically shows a wheel loader in a side view.

DETAILED DESCRIPTION

Figure 1:
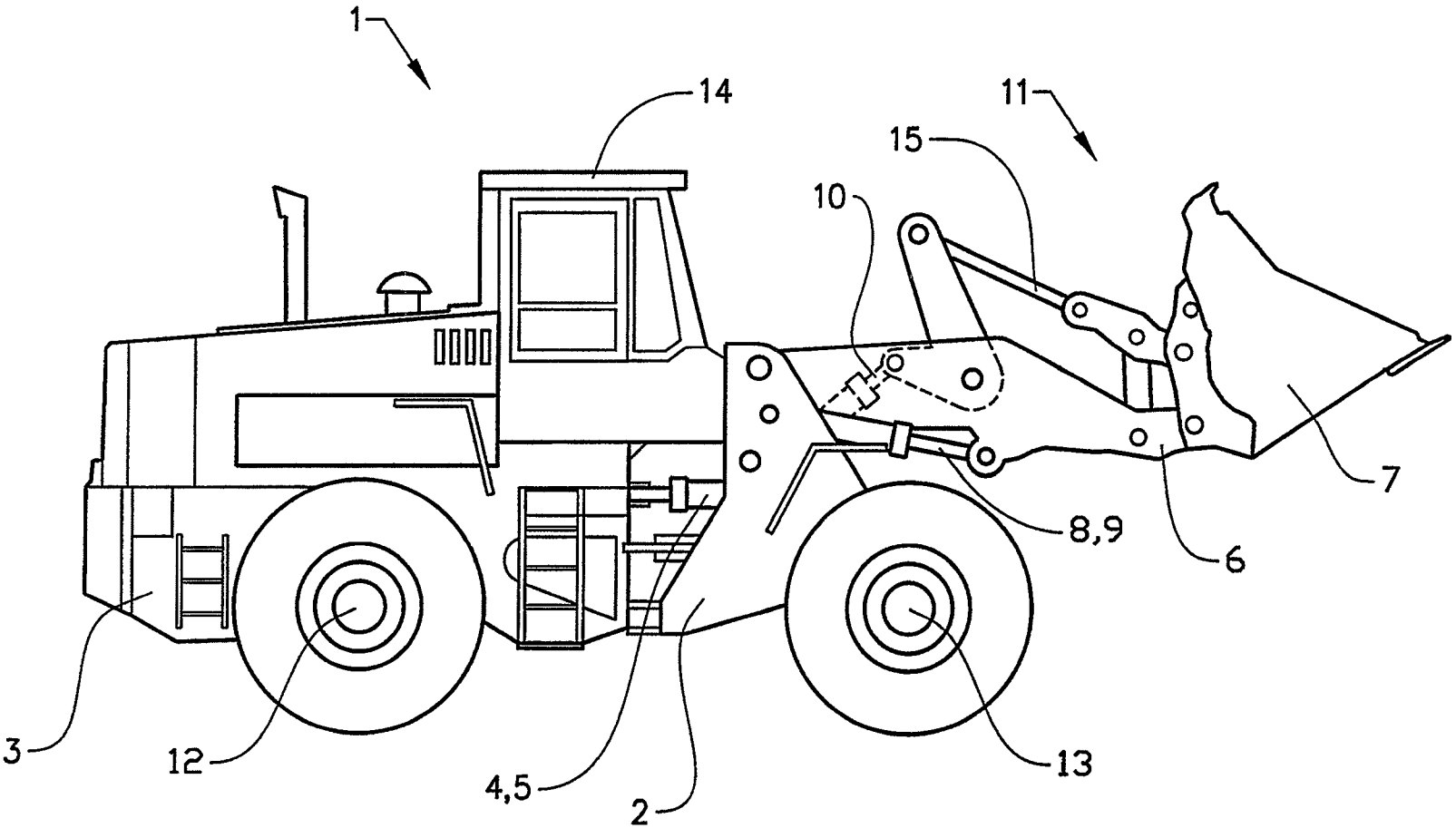

FIG. 1 shows a wheel loader 1. The wheel loader 1 comprises a forward section 2 and a rear section 3, which sections each has a pair of half shafts 12, 13. The forward vehicle section 2 comprises a first frame part and the rear vehicle section 3 comprises a second frame part. The rear section 3 comprises a cab 14. The vehicle sections 2, 3 are connected to each other in such a way that they can pivot in relation to each other around a vertical axis by means of two actuators in the form of hydraulic cylinders 4,5 arranged between the two sections. The hydraulic cylinders 4,5 are thus arranged one on each side of a horizontal centerline of the vehicle in a vehicle traveling direction in order to turn the wheel loader 1.

The wheel loader 1 comprises an equipment 11 for handling objects or material. The equipment 11 comprises a load-arm unit 6 and an implement 7 in the form of a bucket fitted on the load-arm unit. A first end of the load-arm unit 6 is pivotally connected to the forward vehicle section 2. The implement 7 is pivotally connected to a second end of the load-arm unit 6.

The load-arm unit 6 can be raised and lowered relative to the forward section 2 of the vehicle by means of two second actuators in the form of two hydraulic cylinders 8,9, each of which is connected at one end to the forward vehicle section 2 and at the other end to the load-arm unit 6. The bucket 7 can be tilted relative to the load-arm unit 6 by means of a third actuator in the form of a hydraulic cylinder 10, which is connected at one end to the forward vehicle section 2 and at the other end to the bucket 7 via a link-arm system 15.

Figure 2:
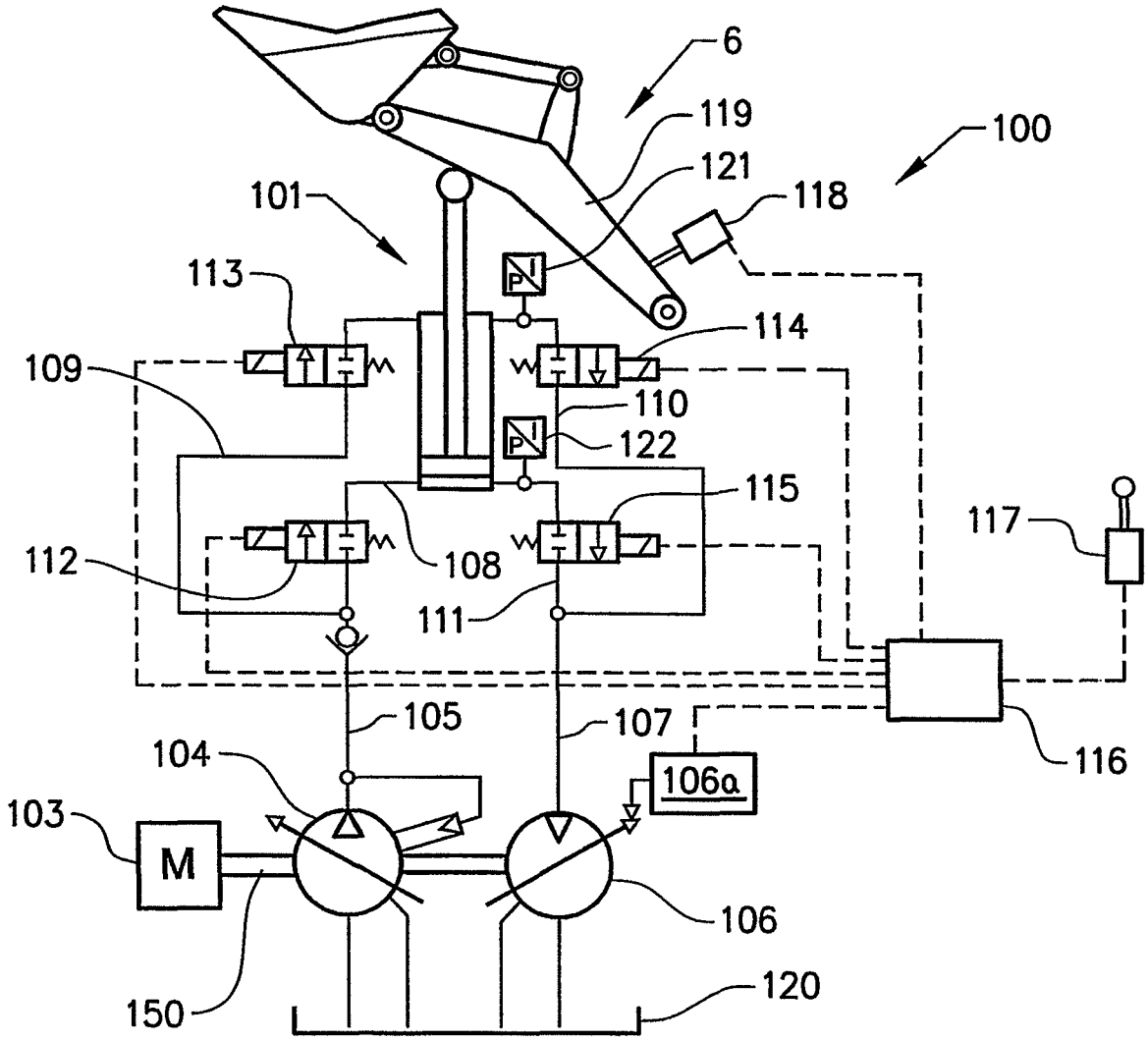
FIG. 2 shows a system for energy recovery of a lifting function during operation of the wheel loader.

FIG. 2 shows a system for damping relative movements and energy recovery in a hydraulic circuit 100 arranged for a lifting operation of the load-arm unit 6. The two lifting cylinders 8,9 from the arrangement shown in FIG. 1 are here, for ease of presentation, replaced by one hydraulic cylinder 101. The arrangement comprises a power source 103 in the form of a diesel engine for propelling the wheel loader. The arrangement further comprises a pump 104, which is rotatably driven by the power source 103.

The hydraulic cylinder 101 is arranged in fluid connection with the pump 104 via a first conduit 105. A variable displacement hydraulic motor unit 106 is arranged in fluid connection with the cylinder 101 and downstream the cylinder via a second conduit 107. Said motor unit 106 comprises a single motor. A fluid container 120 is arranged downstream of the motor 106 for collecting fluid.

The first conduit 105 is branched off in two input conduits 108, 109 to the cylinder. A first input conduit 108 is connected to a piston side and a second input conduit 109 is connected to a piston rod side. Two output conduits 110, 111 are also connected to the cylinder. A first output conduit 110 is connected to the piston rod side and a second output conduit 111 is connected to the piston side. The two output conduits 110, 111 merges to the second conduit 107.

An on/off valve 112, 113, 114, 115 is arranged on each of these four input/output conduits 108, 109, 110, 111. By simultaneously open the on/off valve 112 on the first input conduit 108 and the on/off valve 114 on the first output conduit 110, the load-arm unit 6 may be raised. In the same way, by simultaneously open the on/off valve 113 on the second input conduit 109 and the on/off valve 115 on the second output conduit 111, the load-arm unit 6 may be lowered.

The system comprises a controller, or electronic control unit, 116, which is connected to each of the on/off valves 112, 113, 114, 115 for electrically controlling them, see dashed lines.

The system further comprises a control lever, or joystick, 117 for operation by an operator. The control lever 117 is electrically connected to the controller 116. Operation of the control lever 117 generates a work function signal indicative of a requested raising or lowering of the load-arm unit 6.

All hydraulic fluid from the hydraulic cylinder 101 passes the motor 106. By varying the displacement of the motor 106, the movement speed of the cylinder 101 is controlled during a lifting/lowering operation. Thus, the system in FIG. 2 may not only be arranged for damping and energy recovery, but also be used for moving the cylinder 101.

The system comprises means 118 for determining an angle between an arm 119 of the load-arm unit 6 and the forward vehicle section 2. Said detection means 118 is electrically coupled to the controller 116 and is arranged to sense the position of the arm 119. As an alternative, the angle determining means may be formed by an angular sensor arranged at the joint between the load-arm unit 6 and the forward vehicle section 2. As a further alternative, the angle determining means 118 may be formed by a sensor arranged to sense the extension of the lifting cylinder 101.

Means 121, 122 are provided for sensing a load pressure subjected to the cylinder 101 during operation. Said sensing means is formed by electrical pressure sensors 121, 122, which generate pressure signals to the controller 116. A first pressure sensor 121 is arranged on the output conduit 110 at the piston rod side of the cylinder 101 and a second pressure sensor 122 is arranged on the output conduit 111 at the piston side of the cylinder 101.

The variable displacement hydraulic motor 106 controls the speed of the movement of the load-arm unit 6 during normal operation, i.e. when there is no damping. Further, the fluid connection through the first conduit 105, 108, 109 from the pump 104 to the cylinder 101 is free from actuator movement controlling throttling means. The controller 116 is electrically connected to the motor 106 for adjusting the displacement.

The diesel engine 103 mechanically drives the pump 104 via a drive shaft 150. The drive shaft 150 is also mechanically connected to the motor 106. Thus, the pump 104 and the motor 106 rotates at the same speed during operation. An alternative embodiment will be described below with reference to FIG. 9.

A method for damping relative movements between the forward vehicle section 2 and the load-arm unit 6 and the energy recovery from the relative movement will be described below.

During transport of the wheel loader 1, the on/off valves 112, 113, 114, 115 are closed. When the wheel loader 1 travels over a bump in the ground, the forward vehicle section 2 will move upwards. More specifically, the forward vehicle section 2 will move upwards relative to the load-arm unit 6. Said upward movement of the forward vehicle section 2 leads to an increased pressure on the output piston side of the cylinder 101, which is detected by means of the second pressure sensor 122. The controller 116 continuously receives and registers information of the pressure from the pressure sensors 121, 122. Thus, the controller 116 has information about a ground pressure in the cylinder 116 before the vehicle reaches the bump.

When the detected pressure exceeds the ground pressure to a certain extent, the controller automatically opens the associated on/off valve 115 on the output piston side of the cylinder 101. Thereby, a fluid connection from the actuator 101 to the motor 106 is opened. Further, the displacement of the variable displacement hydraulic motor 106 is controlled in such a manner that energy from the hydraulic fluid flow is transmitted from the motor 106 to the engine 103. The controller 116 also opens the on/off valve 113 on the input piston rod side of the cylinder 101 so that the pump 104 supplies pressurized hydraulic fluid to the input piston rod side of the cylinder 101 during the energy recovery phase. According to an alternative to using the pump, hydraulic fluid may be supplied to the piston rod side of the cylinder 101 via an after fill valve unit, see for example reference numeral 128 in FIG. 3.

A termination of an energy recovery phase is determined by repeatedly detecting at least one of said operation parameters of the vehicle, i.e the pressure and/or angle values. After said termination of the energy recovery phase, the system is controlled so that the load-arm unit 6 resumes its prior position relative to the forward vehicle section 2 after termination of the energy recovery phase. The on/off valve 113 on the input piston side of the cylinder 101 is closed and the on/off valve 112 on the input piston side of the cylinder 101 is opened.

The pump 104 will continue to supply pressurized hydraulic fluid to the input piston side of the cylinder 101 and the on/off valve 114 on the output piston rod side will be opened so that the load-arm unit 6 resumes said prior position.

According to an alternative or complementary step, said upward movement of the forward vehicle section 2 is detected by means of the angle determining means 118. The controller 116 continuously receives and registers information of the angle from the angle determining means 118. Thus, the controller 116 has information about an initial relative angle between the load-arm unit 6 and the forward vehicle section 2 before the vehicle reaches the bump.

A downward movement of the forward vehicle section 2, due to a recess in the ground, is likewise determined by means of the pressure sensors 121, 122 and/or the angle determining means 118. The controller 116 receives information of the determined downward movement and in response automatically opens the on/off valve 114 on the output piston rod side of the cylinder 101. A fluid connection from the actuator 101 to the motor 106 is then opened. Further, the displacement of the variable displacement hydraulic motor 106 is controlled in such a manner that energy is transmitted from the motor 106 to the engine 103. Further, the on/off valve 112 is opened so that the pump 104 supplies pressurized hydraulic fluid to the input piston side of the cylinder 101 during the energy recovery phase.

After termination of the energy recovery phase, the controller 116 closes the on/off valve 112 on the input piston side and opens the on/off valve 113 on the input piston rod side of the cylinder 101. Further, the on/off valve 114 on the piston rod side is closed and the on/off valve 115 on the piston side is opened. The pump 104 will then supply pressurized hydraulic fluid to the input piston rod side of the cylinder 101 so that the load-arm unit 6 resumes its prior position relative to the forward vehicle section 2.

Thus, in principle, when the detected pressure on either side of the cylinder 101 exceeds the ground pressure to a predetermined extent, the outlet on/off valve on that side is automatically opened so that the energy can be recovered via the motor 106. The angular position of the load-arm unit 6 relative to the forward vehicle section 2 is thereafter adjusted to its initial position before the vehicle reached the unevenness in the ground by supplying pressurized fluid to the said side of the cylinder 101.

The limit of the magnitude of the movement of the load-arm unit 6 relative to the forward vehicle section 2 for initiating energy recovery is determined as a function of the detected pressure increase.

Thus, the motor 106 has two functions: 1) recovering energy to the engine 103 during the energy recovery phase during a transport operation, and 2) controlling the movement speed of the cylinder 101 during a lifting/lowering of the load-arm unit 6.

The recovered kinetic energy from the downward movement of the forward vehicle section 2 is larger than the energy consumed by the pump 104 during the travel over the bump/recess, which gives a positive net result.

By virtue of the fact that the kinetic energy from the downward movement of the forward vehicle section 2 is converted to rotational energy recovered to the power source 103, the oscillating movements of the vehicle will be dampened.

Figure 4:
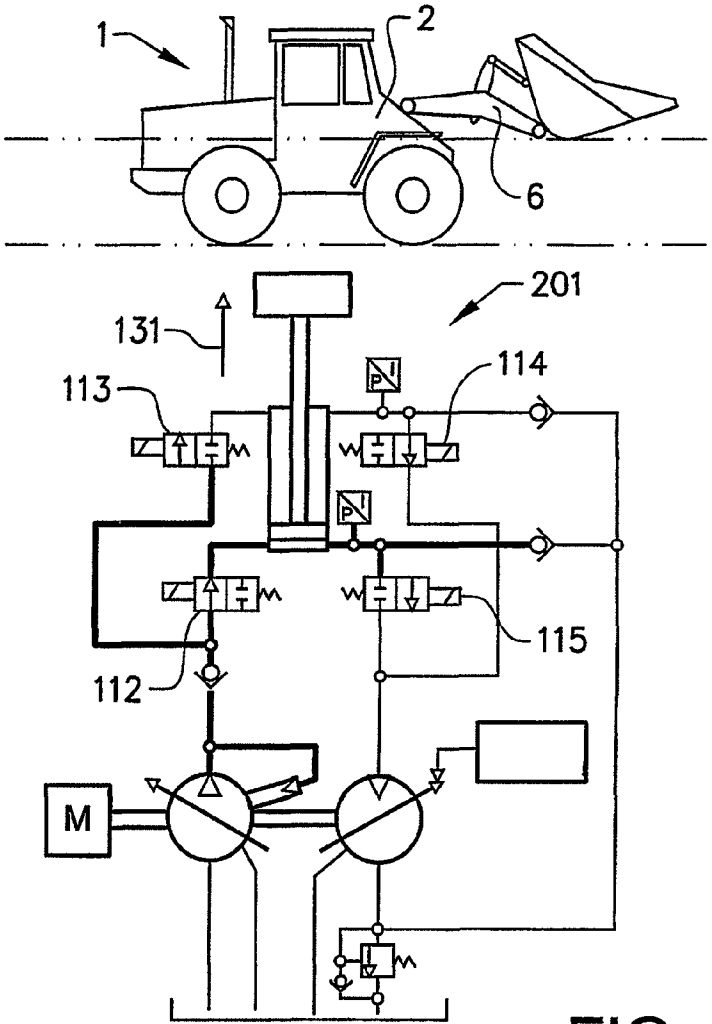
FIGS. 3 and 4 show an alternative system to the one shown in FIG. 2, FIGS. 5 and 6 show a system for energy recovery of a tilting function during operation of the wheel loader.
Figure 3:
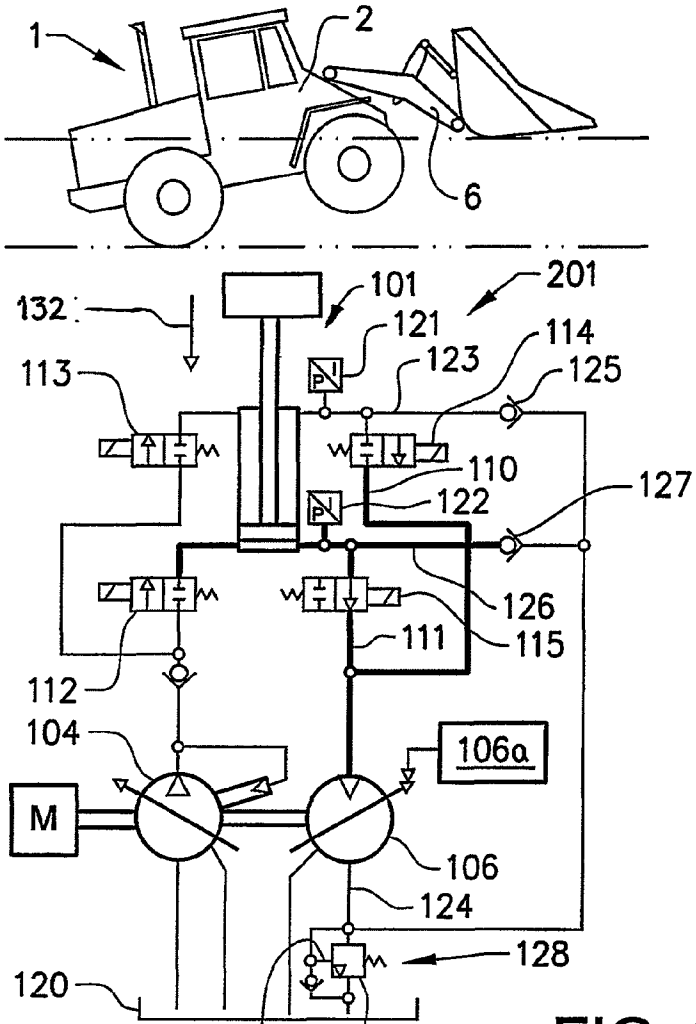

An alternative embodiment of the hydraulic system 100 of FIG. 2 is shown in FIGS. 3 and 4. The hydraulic system 201 in FIGS. 3 and 4 differs from the system 100 in FIG. 1 in the following respects:

A first bypass conduit 123 is connected to the first output conduit 110 from the piston rod side of the cylinder 101 upstream of the associated on/off valve 114 and to a conduit 124 downstream of the motor 106. A nonreturn valve 125 is arranged on the first bypass conduit 123. A second bypass conduit 126 is connected to the second output conduit 111 from the piston, side of the cylinder 101 upstream of the associated on/off valve 115 and to the conduit 124 downstream of the motor 106. A non-return valve 127 is arranged on the second bypass conduit 126.

A valve unit 128 is arranged on the conduit 124 between the motor 106 and the hydraulic fluid container 120. The valve unit 128 is arranged to close and open, respectively the fluid connection from the motor 106 to the tank 120. The valve unit 128 is further arranged downstream of the joint of the bypass conduits 123, 126 and the conduit 124 from the motor 106. The valve unit 128 comprises a spring loaded valve 129 on the conduit 124. The valve 129 is controlled by the pressure in the conduit 128 upstream of the valve 129 via a pilot conduit 130.

FIGS. 3 and 4 show the same system 201 in two different states of the method when the vehicle reaches a raised portion in the ground. The method steps performed are described when the vehicle reaches a raised portion in the ground.

FIG. 3 shows the positions of the on/off valves during the energy recovery phase described above with reference to FIG. 2. An arrow 132 in FIG. 3 illustrates that the vehicle has reached a bump in the ground wherein the cylinder 101 is compressed. FIG. 4 shows the positions of the on/off valves after termination of the energy recovery phase when the load-arm unit 6 is automatically returned to its prior position relative to the forward vehicle section 2, see arrow 131 in FIG. 4 and the description above with reference to FIG. 2.

The hydraulic system 201 shown in FIGS. 3 and 4 may also be used in an alternative method. According to this alternative method, the pump 104 will not supply pressurized fluid to the cylinder 101 during the energy recovery phase. Instead hydraulic energy from undesired relative movements between the load-arm unit 6 and the forward vehicle section 2 will be used to after fill the cylinder 101. Only the main differences of this alternative method relative to the method above will be described below.

The downward arrow 132 in FIG. 3 illustrates that the forward vehicle section 2 moves upwards relative to the load-arm unit 6. The lift cylinder 101 will then be compressed. However, when the controller receives information of the relative motion and an associated pressure increase on the output piston side, it will not open the on/off valve 115 on the output piston side of the cylinder 101. The load-arm unit 6 will then pitch and the pressure will next increase on the piston rod side instead. The on/off valve 114 on the output piston rod side will then automatically be opened by the controller. Thereby, a fluid connection from the cylinder 101 to the motor 106 is opened and the displacement of the variable displacement hydraulic motor 106 is controlled in such a manner that energy is transmitted from the motor 106 to the engine 103. The further on/off valves 112, 113, 115 remain closed.

Further, the valve unit 128 will be in a position in which the fluid connection between the motor 106 and the tank 120 is closed. The fluid from the motor 106 will then be guided to the piston side of the cylinder 101 via the second bypass conduit 126 and after fill the cylinder 101. Note that since the pressure in the conduit on the output piston rod side of the cylinder 101 is high, the non-return valve 125 on the first bypass conduit 123 will be closed.

The on/off valve 114 on the piston rod side is closed when the pressure on the piston rod side is decreased to a certain extent or when the movement of the load-arm unit 6 is decreased to a certain extent. The on/off valve 115 on the piston side is instead opened so that the load-arm unit 6 is moved downwards relative to the forward vehicle section 2 and the energy is recovered via the motor 106. When the load-arm unit 6 reaches its prior, initial position, the on/off valve 115 on the piston side is closed. The method may now be repeated again.

A similar method as the alternative method described above is used when the vehicle 1 instead reaches a recessed portion in the ground. The forward vehicle section 2 will then move downwards relative to the load-arm unit 6. This relative movement is likewise determined by means of the pressure sensors 121, 122 and/or the angle determining means 118. The controller receives information of the determined downward movement and in response automatically opens the on/off valve 114 on the output piston rod side 101. A fluid connection from the actuator 101 to the motor 106 is then opened and the displacement of the variable displacement hydraulic motor 106 is controlled in such a manner that energy is transmitted from the motor 106 to the engine 103. The further method steps are the same as has been described above for the alternative method when the vehicle reaches a bump after the pitching and energy recovery via the on/off valve 114 on the piston rod side.

According to the alternative method described above, a sufficient after filling is required. Therefore, according to a variant, an accumulator (not shown) may be connected to the by-pass conduits 123, 126. According to a further complement/alternative, the pump 104 may be connected during the after filling in order to add further fluid flow if necessary. The controller can determine if such after filling is necessary based on the detected pressure on the piston side. According to a further variant, the pump 104 is connected to the bypass conduits 123, 126 and adds a low pressure to the after filling output side of the cylinder.

Figure 6:
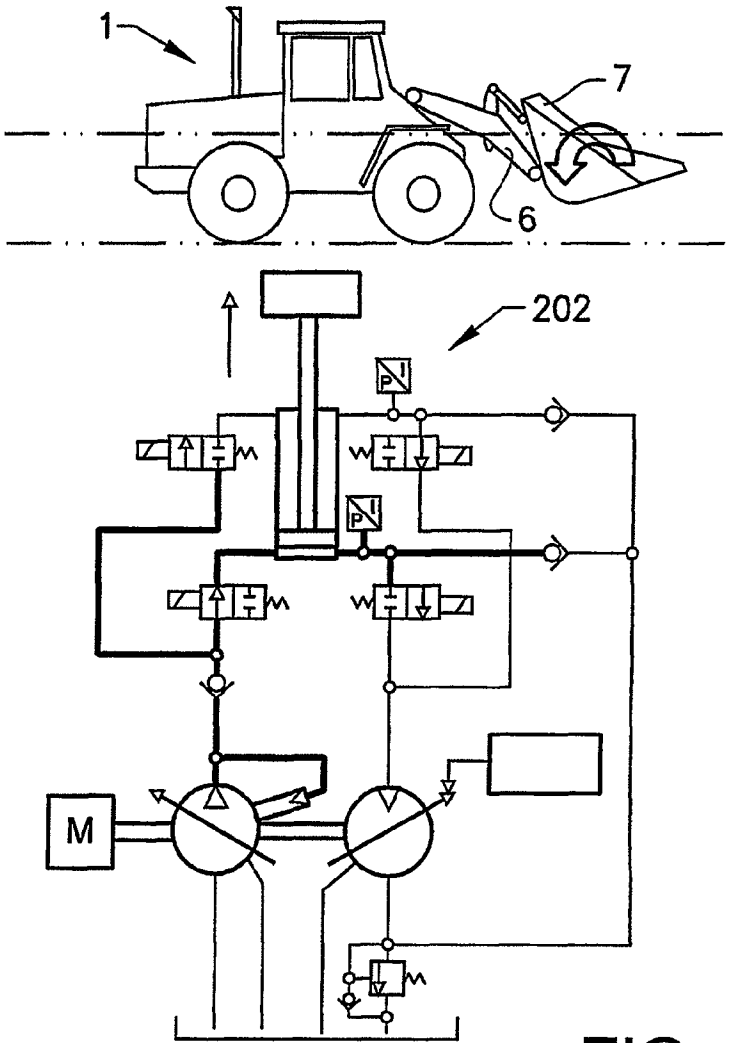
Figure 5:
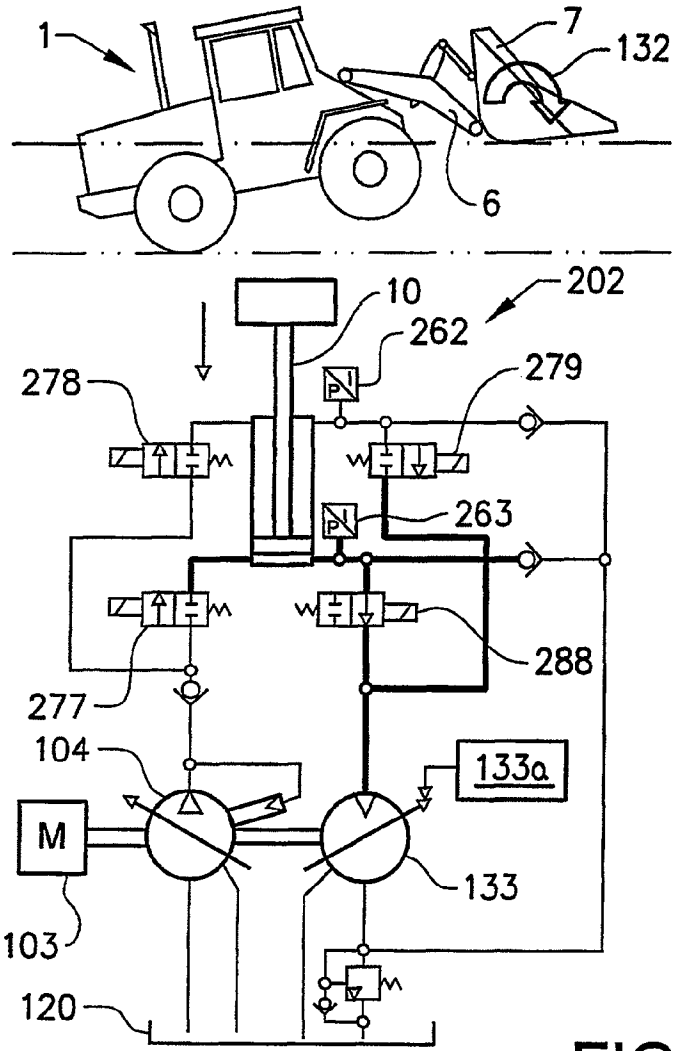

FIGS. 5 and 6 shows a hydraulic system 202 arranged for a tilting operation of the implement 7 relative to the load-arm unit 6. The system and energy recovery method for the tilting function is very similar to what has been described above for the lifting function. When the vehicle 1 reaches a raised portion in the ground, the load-arm unit 6 will move relative to the implement 7 by a clockwise rotating motion due to the mass inertia in the implement 7, see arrow 132 in FIG. 5. The tilt piston of the tilt cylinder 10 is then forced into the cylinder.

When the vehicle 1 instead reaches a recessed portion in the ground, the load-arm unit 6 will move relative to the implement 7 by a counterclockwise rotating motion due to the mass inertia in the implement 7.

In the same way as has been described above for the alternative lifting hydraulic circuit 201, the power source 103 in the form of a diesel engine for propelling the wheel loader rotatably drives the pump 104. The tilt cylinder 10 is arranged in fluid connection with the pump 104 via a first conduit. A variable displacement hydraulic motor unit 133 is arranged in fluid connection with the cylinder 10 and downstream the tilt cylinder 10 via a second conduit. Said motor unit 133 comprises a single motor. The fluid container 120 is arranged downstream of the motor 133 for collecting hydraulic fluid.

The arrangement of conduits, on/off valves, pressure sensors etc is of the same type as has been described above for the lifting system. The hydraulic system 202 for the tilting function comprises a pair of inlet on/off valves 277, 278 and a pair of outlet on/off valves 279, 288 arranged in the same way as the on/off valves of the hydraulic circuit 201 for the lifting function. Further, a pressure sensor 262 is arranged on the output piston rod side of the cylinder 10 and a pressure sensor 263 is arranged on the output piston side of the cylinder 10. The upward movement of the load-arm unit 6 may, as an alternative to the means 118 for determining a relative angle between the forward vehicle section 2 and the load-arm unit 6, be formed by means (see sensor 255 in FIG. 9) for determining a relative angle between the load-arm unit 6 and the implement 7.

FIGS. 5 and 6 show the same system in two different states when the vehicle reaches a raised portion in the ground. FIG. 5 shows the positions of the on/off valves during the energy recovery phase and FIG. 6 shows the positions of the on/off valves after termination of the energy recovery phase when the implement 7 and the load-arm unit 6 are automatically returned to their prior relative position.

The methods for energy recovery from the tilting function work by the same principle as have been described above for the lifting function; when the detected pressure on either side of the cylinder 10 exceeds the ground pressure to a predetermined extent, the outlet on/off valve on that side is automatically opened so that the energy can be recovered via the motor 133. Since the methods have been described in detail for the lifting function, they will not be repeated for the tilting function.

Figure 8:
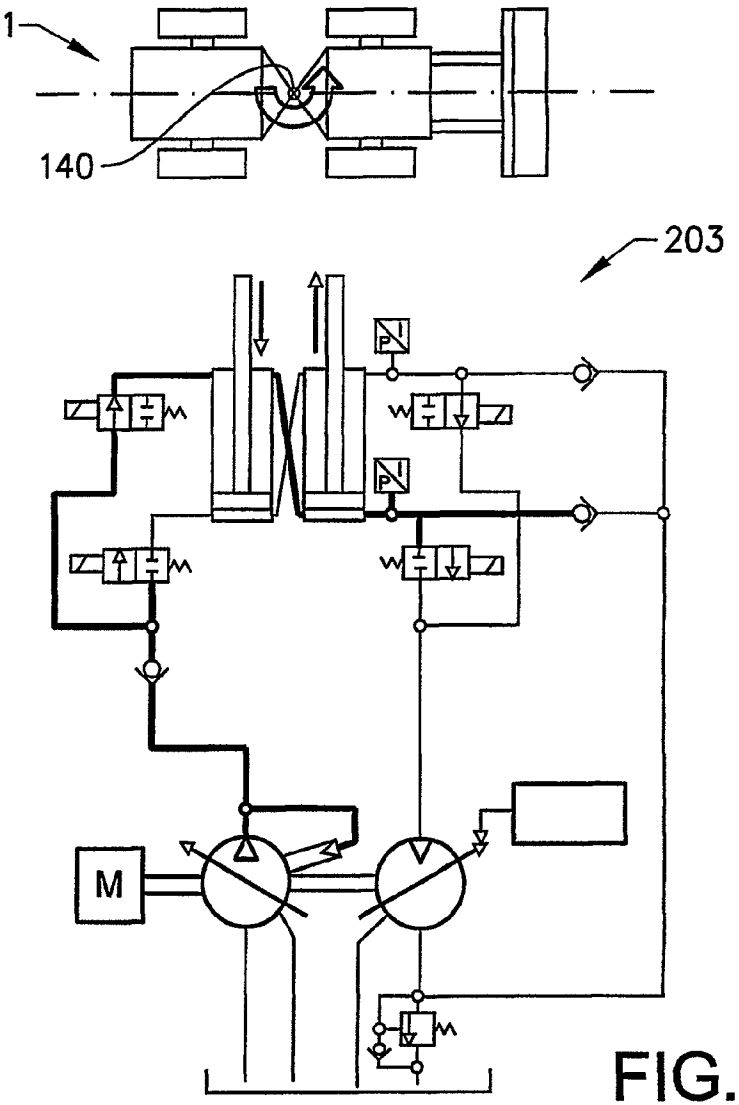
FIGS. 7 and 8 show a system for energy recovery of a steering function during operation of the wheel loader.
Figure 7:
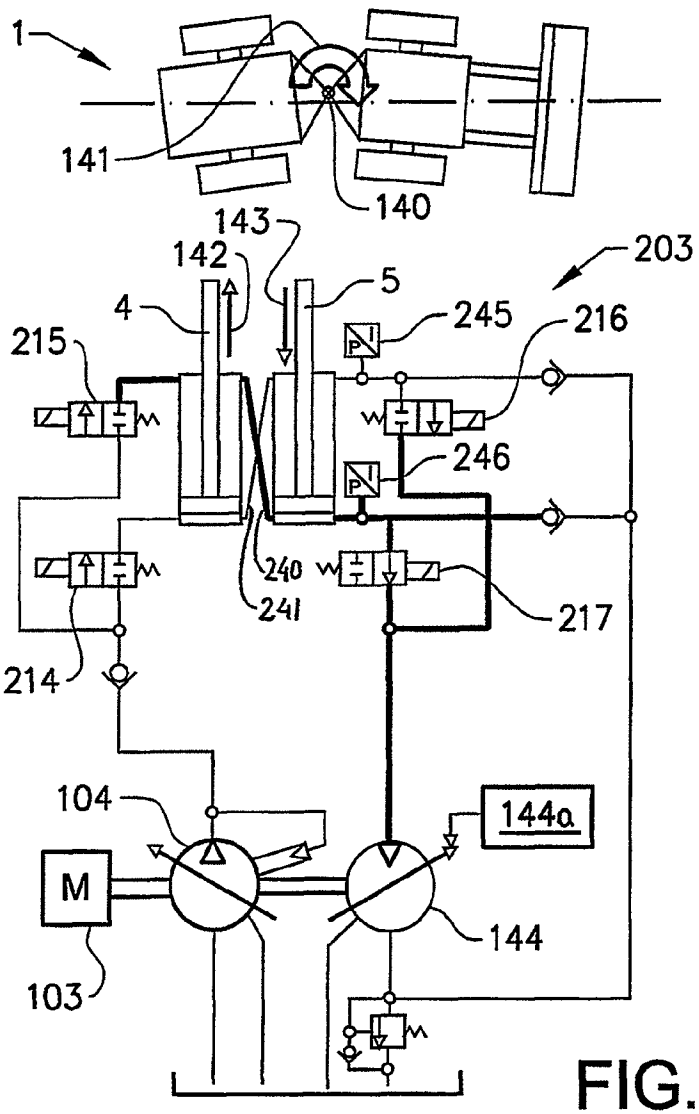

FIGS. 7 and 8 show a hydraulic system 203 arranged for a steering operation of the forward vehicle section 2 relative to the rear vehicle section 3. The system and energy recovery method for the steering function is very similar to what has been described above for the lifting and tilting function.

The arrangement of conduits, on/off valves, pressure sensors etc is of the same type as has been described above for the lifting and tilting system.

The two steering cylinders 4,5 are interconnected by means of two intermediate conduits 240, 241 running crosswise. Thus, the steering cylinders 4,5 are arranged to simultaneously move in opposite directions. A first intermediate conduit 240 connects the piston rod side of the first steering cylinder 4 with a piston side of a second steering cylinder 5. A second intermediate conduit 241 connects the piston side of the first steering cylinder 4 with the piston rod side of the second steering cylinder 5.

An on/off valve 214, 215, 216, 217 is arranged on each of the four input/output conduits of the steering cylinders 4,5. By simultaneously open the on/off valve 214 on the input piston side of the upstream cylinder 4 and the on/off valve 217 on the output piston side of the downstream cylinder 5, the vehicle may be turned in a first direction. In the same way, by simultaneously open the on/off valve 215 on the input piston rod side of the upstream cylinder 4 and the on/off valve 216 on the output piston rod side of the downstream cylinder 5, the vehicle may be turned in a second, opposite direction.

The controller 116 is connected to each of the on/off valves 214, 215, 216, 217 for electrically controlling them.

Figure 9:
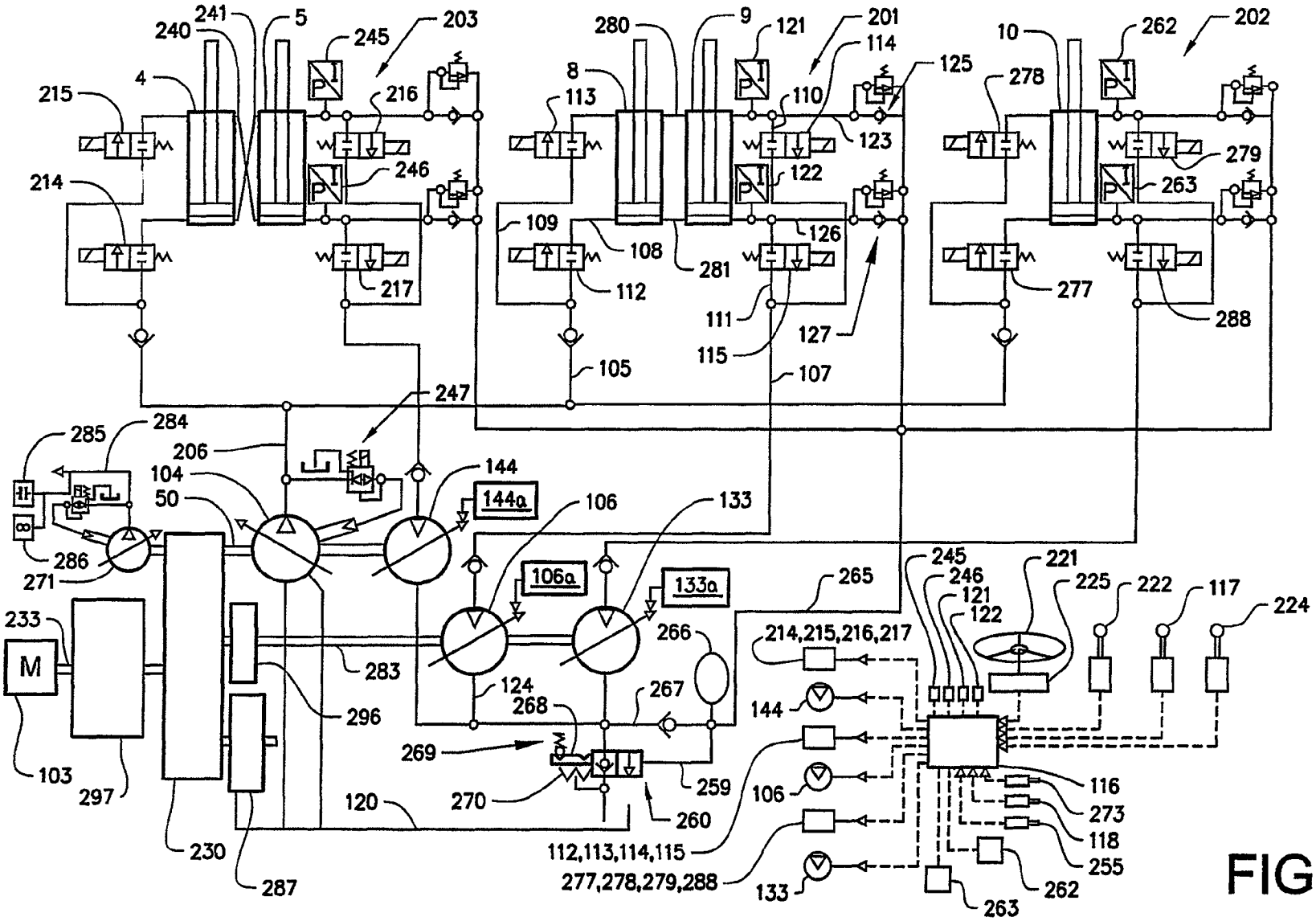
FIG. 9 shows a system for energy recovery in a wheel loader comprising a steering, lifting and tilting function.

The arrangement comprises a first steering means in the form of a steering wheel 221 for operation by an operator, see FIG. 9. An angle sensor 225 of the steering wheel 221 is electrically connected to the controller 116. Operation of the steering wheel 221 generates a work function signal indicative of a requested steering of the vehicle. The arrangement further comprises a second steering means in the form of a control lever, or joystick, 222 for operation by an operator. The steering control lever 222 is electrically connected to the controller 116. Operation of the control lever 222 generates a work function signal indicative of a requested steering of the vehicle. The operator of the vehicle may choose which of the two steering means 221, 222 he prefers in a certain situation.

Means 245, 246 are provided for sensing a load pressure subjected to the cylinders 4,5 during operation. Said sensing means is formed by electrical pressure sensors 245, 246, which generate pressure signals to the controller 116.

According to the damping and energy recovery method, undesired relative movements between the forward vehicle section 2 and the rear vehicle section 3 around a steering joint 140, which arise during advance of the vehicle over uneven ground, are damped and the energy from the relative movements is recovered.

An undesired relative rotation motion of the forward and rear vehicle sections 2, 3, see arrow 141 in FIG. 7, is detected by pressure sensors and/or means for determining an angular position between the vehicle sections 2, 3. The piston of a first steering cylinder 4 is then pulled out of the cylinder and the piston of a second steering cylinder 5 forced into the cylinder, see arrows 142 and 143 in FIG. 7.

In the same way as has been described above for the alternative lifting hydraulic circuit 201, the power source 103 in the form of a diesel engine for propelling the wheel loader rotatably drives the pump 104. The steering cylinders 4,5 are arranged in fluid connection with the pump 104 via a first conduit. A variable displacement hydraulic motor unit 144 is arranged in fluid connection with the cylinders 4,5 and downstream the cylinders 4,5 via a second conduit. Said motor unit 144 comprises a single motor. The fluid container 120 is arranged downstream of the motor 144 for collecting hydraulic fluid.

FIGS. 7 and 8 show the same system in two different states. FIG. 7 shows the positions of the on/off valves during the energy recovery phase and FIG. 8 shows the positions of the on/off valves after termination of the energy recovery phase when the forward and rear vehicle sections are automatically returned to their prior relative position.

The methods for energy recovery from the steering function work by the same principle as have been described above for the lifting function; when the detected pressure on either side of the cylinders 4,5 exceeds the ground pressure to a predetermined extent, the outlet on/off valve on that side is automatically opened so that the energy can be recovered via the motor 144. Since the methods have been described in detail for the lifting function, they will not be repeated for the steering function.

The variable displacement pump 104 comprises a drive shaft, a rotatable cylinder barrel having multiple piston bores, pistons held against a tiltable swashplate, and a valve plate. When the swashplate is tilted relative to the longitudinal axis of the drive shaft, the pistons reciprocate within the piston bores to produce a pumping action and discharge the pressurized fluid to an outlet port. When the swashplate is positioned at the center and is not tilted, the pistons do not reciprocate and the pump does not produce any discharge pressure.

The variable displacement hydraulic motor 106, 133, 144 comprises a drive shaft, a rotatable cylinder barrel having multiple piston bores, pistons held against a tiltable swashplate, and a valve plate. When the swashplate is tilted relative to the longitudinal axis of the drive shaft, the pistons reciprocate within the piston bores to produce a pumping action. The pumping action by the pistons rotates the cylinder barrel and the drive shaft, thereby providing a motor torque output when the fluid pressure at an inlet port is higher than an outlet port. When the swashplate is positioned at the center and is not tilted, the pistons do not reciprocate and the motor does not produce any output torque.

Means 106*a*, 133*a*, 144*a* is in operational contact with the swashplate of the associated pump for regulating the displacement. The regulating means 106*a*, 133*a*, 144*a* is electrically controlled by the controller 116. The regulating means 106*a*, 133*a*, 144*a* comprises, according to one example, an electrically controlled proportional valve for effecting the swashplate with pressurized fluid and thereby moving it. The regulating means 106*a*, 133*a*, 144*a* further comprises an angle sensor, which is arranged to sense the position of the swashplate in order to terminate the movement of the swashplate when the desired angular position is achieved.

FIG. 9 shows a preferred embodiment of an arrangement for controlling the wheel loader 1 of FIG. 1. The arrangement comprises the above described hydraulic systems 201, 202, 203 in somewhat modified form for controlling lifting, tilting and steering (turning) of the wheel loader 1.

The power source 103 rotationally drives pump 104, which is common for the three systems 201, 202, 203.

The diesel engine 103 mechanically drives the pump 104 via a transmission 230 and a drive shaft 50. The drive shaft 50 is also mechanically connected to the motor 144 for the steering function. Thus, the pump 104 and the motor 144 rotates at the same speed during operation.

The hydraulic circuit forms a load sensing system. The load sensing hydraulic system is characterized by that the operating condition of the load is sensed and that the output pressure of the pump 104 is controlled so that it exceeds the load pressure existing in the cylinders by a predetermined differential.

Further, an electrically controlled pressure reducing valve 247 is arranged in connection to the pump 104 for regulating the output pressure of the pump. The pressure reducing valve 247 is arranged on a side conduit between a first conduit 206 from the pump 104 to the steering cylinder 4,5 and the displacement control means of the pump 104 for regulating a fluid connection between the first conduit and the pump. In other words, the pressure reducing valve 247 is adapted to send a hydraulic LS signal to the pump 104 depending on a signal from the controller 116. Thus, the signal from the controller may be dependent or independent of the pressure level sensed by the pressure sensors 245, 246.

Further, in some load cases, there is a requirement to aid to after-fill the cylinders when the pump 104 cannot supply the desired fluid flow. A two position backup valve 260 is arranged downstream of the motors 106, 133, 144. Below follows a description of the after-filling with regard to the lifting cylinder, but it is equally applicable for the steering and tilting cylinders.

Said non-return valve 125, 127 is arranged on the outlet conduit 123, 126 connected to the piston rod side and the piston side, respectively, of the cylinder. These outlet conduits 123, 126 merge to a common conduit 265 connected to the motor 106 downstream of the motor 106, bypassing the backup valve 260. A pilot pressure conduit 259 is connected to the common conduit 265 and to a pilot pressure side of the backup valve 260 for acting on the backup valve with a pilot pressure. In this way, the backup valve may block the fluid connection from the motor 106 to the tank 209 and the fluid will therefore flow back to the cylinder via a conduit 267 bypassing the backup valve 260, via the common conduit 265 and the outlet conduit 123, 126.

The backup valve 260 is arranged to be closed when there is a need to after-fill the cylinders and be open when no after-fill is needed. A rod 268 is connected to one side of the backup valve 260 opposite the pilot pressure side. The rod 268 has two grooves at a distance from each other, defining the two positions of the backup valve 260. A spring loaded ball 269 is adapted to be received in one of said grooves at a time. Further, the backup valve 260 is spring loaded via a spring 270.

An accumulator 266 is in fluid connection with the common conduit 265, which extends between the motor 106 and the outlet side of the downstream cylinder 9. The accumulator 266 is arranged in such a way that the backup valve 260 will not be moved too frequently. Thus, it extends the life of the backup valve. When the accumulator 266 is charged to a certain level, the backup valve 260 will open completely and there will be no pressure drop over the valve. When the pressure of the accumulator 266 falls to a certain level, the backup valve will close again and the accumulator 266 will be recharged. When there is no need to after-fill the cylinder, the accumulator will provide a sufficient pressure in order to keep the backup valve in the open position and thereby not generate any pressure drop. The backup valve 260 is required to have a certain hysteresis. The backup valve 260 is designed to close at a low pressure level (for example 4 bar) and open at a higher pressure level (for example 8 bar).

The function of backup valve 260 system described above is not only applicable when the pump cannot supply the desired fluid flow to the cylinder. It is also applicable for example when the load arm unit 6 is lowered or when the bucket 7 is emptied and the movement is performed totally by the action of the gravity force. The inlet side of the cylinder may in this case be closed and the pump may be used for other purposes.

Means 273 is arranged to sense a relative angle between the forward vehicle section 2 and the rear vehicle section 3. The sensor 273 is electrically coupled to the controller 116. Thus, the controller 116 receives information about the relative position of the two vehicle sections.

The recovered energy may be used by the engine 103 to drive other systems, like a vehicle driveline 287 and service brakes 285, and components like fans 286, generators etc, via a branch line 284. A second pump 271 is arranged for supplying the components 285, 286 with pressurized fluid and is rotationally driven by the engine 204 via the transmission 230.

The lift cylinders 8,9 are arranged to simultaneously move in the same direction. The lift cylinders 8,9 are interconnected by means of two intermediate conduits 280, 281. A first intermediate conduit 280 connects the piston rod sides of the cylinders 8,9 and a second intermediate conduit 281 connects the piston sides of the cylinders 8,9.

The system comprises a tilting control means 224, in the form of a control lever, for operation by an operator. The tilting control means 224 is electrically connected to the controller 116. Operation of the tilting control means 224 generates a work function signal indicative of a requested tilting of the bucket 7.

A coupling means 296 is arranged between the engine 204 and the motors 106, 133 for the lifting and tilting functions for disconnecting the motors from a driving connection with the engine. More specifically, the coupling means 296 is arranged on a common drive shaft 283 between the motors 106, 133 and the transmission 230. The coupling means 296 is formed by a hydraulic disc clutch or a freewheel.

A generator 297 is rotationally connected to the engine 103. In the shown example in FIG. 9, the generator 297 is connected on an output shaft 233 from the engine 103, between the engine 103 and the transmission 230. The recovered energy from the motor (s) 106, 133, 144 may be stored in the generator 297. As an alternative, a battery (not shown) is connected to the generator 297. The battery may in turn be connected to a further energy consumer. The generator 297 may further be used as a motor and regenerate energy from the battery.

The wheels of the wheel loader 1 are driven by the half shafts 12, 13, see FIG. 1, which in turn are driven by the engine 103 via the driveline in a per se known way. A converter 287 in the driveline is indicated in FIG. 3. The converter 287 is driven by the engine 103 via the transmission 230. Any recovered energy in the hydraulic motors 106, 133, 144 may be used for propelling the vehicle via the converter 287.

The work vehicle may have a hydrostatic transmission. In such a case, the recovered energy may also be used by the engine 103 to drive pumps or other components in the hydrostatic transmission.

Further, thanks to the invention, conditions are created for integration of pump functions of different systems in the vehicle.

According to a first example, the vehicle is equipped with a hydrostatic transmission. The hydrostatic transmission may comprise two pumps. These pumps may partly be used for work functions like lift, tilt and auxiliary functions. These work functions do not need high flows when the vehicle is driven with high speed, which means that the pumps can be used for propelling the vehicle. Instead, said work functions require larger flows at lower vehicle speeds, when the hydrostatic transmission does not require large flows. Thus, the pump flow requirements of said work functions and the hydrostatic transmission complement each other. In the case that the hydrostatic transmission only has one pump, it may also be used for both the hydrostatic transmission and to said work functions. In the latter case, each system needs to be able to manage the maximum pressure level of the other system.

The controller 116 comprises a memory, which in turn comprises a computer program with computer program segments, or a program code, for implementing the control method when the program is run. This computer program can be transmitted to the controller in various ways via a transmission signal, for example by downloading from another computer, via wire and/or wirelessly, or by installation in a memory circuit. In particular, the transmission signal can be transmitted via the Internet.

The invention also relates to a computer program product comprising computer program segments stored on a computer-readable means for implementing the measurement method when the program is run. The computer program product can consist of comprise, for example, a diskette or a CD.

Although the power source is arranged for propelling the vehicle according to the preferred embodiments described above, the term "power source" is not limited to a unit for propelling the vehicle. The term "power source" should be interpreted in a broad sense to also comprise any energy consuming, energy absorbing or energy storing source. Such an energy storing source may be conFIG.d to store energy hydraulically, for example with an accumulator, electrically, for example by means of a generator, or mechanically, for example by means of an apparatus for rotating masses. Further, the power source may be an electric engine or a hydraulic pump.

The invention is not in any way limited to the above described embodiments, instead a number of alternatives and modifications are possible without departing from the scope of the following claims.

According to an alternative to using only one motor 106, 133, 144 for each work function, the term motor unit comprises a plurality of motors. The plurality of motors in a single motor unit may be arranged in series on a common drive shaft. The plurality of motors in a single motor unit are further arranged in parallel with respect to a fluid connection to the associated actuator so that at least one of the motors in the motor unit may be disconnected from fluid connection with the associated actuator.

According to a further alternative, several work functions may share one single hydraulic motor unit. Each such work function is then arranged to be connectable to the single motor unit via a respective valve unit arranged between the hydraulic cylinder and the motor unit. Preferably, the valve unit is adapted to either connect the hydraulic cylinder of the work function in question to the single motor unit or directly to tank.

One of said work functions could be to rotate an upper section of the vehicle in relation to a lower section of the vehicle. This is a commonly used arrangement for excavators, where the upper section comprises a cab and the lower section comprises ground engaging members, like tracks or wheels. The actuator is in this case formed by a hydraulic motor.

As an alternative to the arrangement of the hydraulic motors 106, 133 on the common drive shaft 283, see FIG. 9, the two motors may be arranged on different drive shafts.

According to one alternative of the above described embodiment, in which a common pump is used for all work functions, one pump may be used for each work function.

According to an alternative use of the method described above, it may be used for recovering energy from external loads or chocks applied to the system. Such a chock may arise when the vehicle is used for bucket operation and the bucket is brought into contact with a stone or similar hard material when the vehicle is forwarded into the material to be handled. A further example of generation of such a chock may arise during timber handling if timber logs fall down on the equipment. Such occurrence would lead to a high pressure in the lift cylinder. When such a high pressure is detected, the chock energy may be recovered via the motor unit in the way described above. The position of the hydraulic cylinder may thereafter be adjusted by supplying pressurized hydraulic fluid from the pump.

The invention claimed is:

1. A method for damping relative movements occurring between a first and a second part of a work vehicle during advance of the vehicle, which parts are interconnected by means of at least one hydraulic actuator, comprising advancing the vehicle by rolling the vehicle by way of ground-engaging elements, repeatedly detecting a hydraulic fluid pressure associated with the actuator resulting from rolling the vehicle, determining whether a damping condition is present based on a predetermined change in values of the hydraulic fluid pressure that is detected, if the determined damping condition is present, controlling a displacement of a variable displacement hydraulic motor arranged downstream of the actuator by initiating an energy recovery phase during which flow communication between a chamber of the actuator and the motor is opened and hydraulic fluid is transmitted from the actuator to the motor so that energy from the hydraulic fluid is recovered by being converted to a rotational energy in the motor, transmitting the recovered energy from the motor to a power source, and after termination of the energy recovery phase, automatically moving the first and second parts relative to one another to a relative position existing prior to determining whether the damping condition is present.

2. A method according to claim 1, comprising detecting an angle between the first and second parts, and determining whether the damping condition is present based on a value of the angle that is detected.

3. A method according to claim 2, further comprising repeatedly detecting the angle and determining whether the damping condition is present based on a predetermined change in values of the angle that is detected.

4. A method according to claim 1, comprising repeatedly detecting an angle between the first and second parts, and determining whether the damping condition is present based on a predetermined change in values of the angle that is detected, and determining the damping condition as a function of a relationship in the change in the values of the angle that is detected and the change in the values of the hydraulic fluid pressure that is detected.

5. A method according to claim 1, wherein the first part is formed by an arm of a load-arm unit and the second part is formed by a vehicle section comprising a vehicle frame part.

6. A method according to claim 1, wherein the first part is formed by an arm of a load-arm unit and the second part is formed by an implement.

7. A method according to claim 1, wherein the first part is formed by a first vehicle section comprising a first vehicle frame part and the second part is formed by a second vehicle section.

8. A method according to claim 1, further comprising determining a termination of an energy recovery phase, the energy recovery phase having been initiated by the determination of the damping condition, by repeatedly detecting the at least one operation parameter.

9. A method according to claim 1, further comprising initiating the energy recovery phase by the determination of the damping condition.

10. A method according to claim 9, wherein the two parts are moved relative to one another by means of the actuator.

11. A method according to claim 9, further comprising the step of closing a fluid connection from the actuator to the motor after termination of the recovery phase.

12. A computer comprising computer program segments for implementing the method as claimed in claim 1.

13. A computer program product comprising computer program segments stored on a non-transitory computer-readable medium for implementing the method as claimed in claim 1.

* * * * *